United States Patent [19]

Laapotti et al.

[11] Patent Number: 4,919,762

[45] Date of Patent: Apr. 24, 1990

[54] PRESS SECTION AND PRESS SECTION/FRAME CONSTRUCTION COMBINATION IN A PAPER MACHINE

[75] Inventors: Jorma Laapotti, Palokka; Olli Tapio, Jyväskylä, both of Finland

[73] Assignee: Valmet Paper Machinery Inc., Finland

[21] Appl. No.: 209,080

[22] Filed: Jun. 17, 1988

[30] Foreign Application Priority Data

Jun. 17, 1987 [FI] Finland ..... 872693

[51] Int. Cl.[5] ..... D21F 3/04

[52] U.S. Cl. ..... 162/360.1; 162/273; 162/305; 162/359

[58] Field of Search ..... 162/305, 358, 360.1, 162/272–274, 359

[56] References Cited

U.S. PATENT DOCUMENTS

| | | | |
|---|---|---|---|
| 2,415,351 | 2/1947 | Hornbostel | 162/305 |
| 3,861,996 | 1/1975 | Dorfel | 162/306 |
| 4,075,056 | 2/1978 | Ely et al. | 162/360.1 |
| 4,188,262 | 2/1980 | Kankaanpaa | 162/360.1 |
| 4,525,241 | 6/1985 | Laapotti | 162/305 |
| 4,608,125 | 8/1986 | Autio | 162/273 |
| 4,657,634 | 4/1987 | Autio | 162/360.1 |
| 4,704,192 | 11/1987 | Cronin | 162/306 |

FOREIGN PATENT DOCUMENTS 697338 9/1953 United Kingdom ..... 162/360.1

OTHER PUBLICATIONS

Locke "Felts are Key Factor in Performance of Vacuum Pick Up" Paper Trade Journal, Aug. 1966.

*Primary Examiner*—Karen M. Hastings
*Attorney, Agent, or Firm*—Steinberg & Raskin

[57] ABSTRACT

A press section of a paper machine includes a first upper fabric, a pick-up suction roll within a loop of the first upper fabric for transferring a web from the forming wire of the paper machine onto the first upper fabric, a first lower fabric, a lower first press roll within a loop of the first lower fabric forming a first double-felted nip with the pick-up suction roll, a smooth-surfaced center roll, a second press roll situated within the loop of the first upper fabric forming a second single-felted nip with the center roll through which the first upper fabric passes, and wherein the first upper fabric has a substantially straight run between the first double-felted nip and the second single-felted nip. The press section frame construction includes a front and a rear frame which are not directly connected to each other defining an at least partly open space between them through which most of the press rolls can be replaced, the pick-up suction roll and lower first press roll being mounted on the front frame, the second press roll being mounted on the front frame, and the center roll being supported by a stationary frame part.

20 Claims, 4 Drawing Sheets

PRESS SECTION AND PRESS SECTION/FRAME CONSTRUCTION COMBINATION IN A PAPER MACHINE

BACKGROUND OF THE INVENTION

The present invention relates generally to paper making machines and, more particularly, to press sections and press section-frame construction combinations in paper making machines.

In press sections of the type with which the invention is concerned, a paper web formed on the wire part of the paper machine is passed through a first double-felted press nip wherein dewatering of the paper web takes place through both faces of the web. The press section also includes a smooth-surfaced center roll which forms at least one single-felted press nip through which a first fabric which passes through the first double-felted nip also passes. The web separates from the first fabric at the first single-felted press nip and is carried on the smooth surface of the center roll, preferably into a second single-felted nip provided with its own press fabric. The web is then detached from the smooth surface of the center roll, preferably as an open draw, for further processing.

The frame construction to which the invention is directed includes in the direction of web run, a first front frame, a second rear frame, and, possibly, an intermediate frame, on which the press rolls are mounted.

The starting point of the invention is a further development of the Sym-Press II press section available from applicants' assignee, Valmet Paper Machinery Inc. of Finland. The construction of the Sym-Press II press section is disclosed in Finnish Announcement Publication 50,651 corresponding to U.S. Pat. No. 4,209,361.

With regard to the prior art related to the invention, reference is also made to U.S. Pat. Nos. 4,257,844 and 4,192,711, Finnish patent 72,159, and the articles in the publications *Das Papier*, Heft 1, pages 33 to 34, 1981, and *Norsk Skogindustri*, No. 3, 1974, page 80.

A modification of the Sym-Press II press section is described in the latter articles in which the suction roll does not form a nip with the smooth-surfaced center roll and wherein the first double-felted press nip in which web dewatering takes place in two directions is provided in connection with or ahead of the suction roll. Instead of the Sym-Press suction roll, a hollow-faced press roll is provided in nip-defining relationship with the smooth-surfaced center roll to form a second press nip. A third press nip is formed substantially at the opposite side of the smooth-surfaced center roll with respect to the second nip.

In the press sections disclosed in the above-mentioned publications, it has been necessary to use a suction roll either as a press roll or in order to alter the direction of the web-supporting pick-up felt upwardly towards the second nip. However, the use of a suction roll or any other corresponding suction device results in considerable drawbacks. For example, the perforated surface of a suction roll tends to leave markings in the web which are detrimental to the appearance of the paper and which may affect its surface properties. Press suction rolls are expensive, require their own drive motor and regulation system and are noisey in operation.

Furthermore, although it is desireable to provide for crown adjustment of press-suction rolls, this is generally not possible since the mantle of the suction roll is perforated and/or since the interior space within the roll is occupied by the suction equipment to such an extent that the crown adjustment devices cannot be fitted inside the roll. One of the objects of the present invention is to eliminate this drawback.

With regard to conventional frame constructions for press sections, difficulties arise in the replacement of press fabrics as well as of press rolls. These problems have become more severe as the widths of paper machines have increased due to the fact that the press rolls have become longer and heavier. The increased use of press fabrics made of pastic material which are substantially rigid have also increased the difficulty of replacement of the press fabrics since such fabrics cannot be easily folded into small bundles.

In an attempt to overcome the difficulties of replacing the press rolls and press fabics, a frame construction has been designed by Beloit Corporation, designated by it as the Flip-Top frame construction, in which a top frame is situated above the press rolls. The top frame is provided with a pivot shaft extending parallel to the transverse direction of the paper machine so that either the top part of the front frame or the top part of the rear frame can be pivoted around the pivot shaft to open a portion of the frame. However, both of the top parts of the frame cannot be opened at the same time. Opening the top part of the front frame facilitates the replacement of the pick-up fabric of the press section as well as the fabric that usually passes through the first and second nips. The top part of the rear frame is locked during such replacement to support the open top part of the front frame. In a corresponding manner, when the top part of the rear frame is pivoted to its open position, such as to facilitate replacement of the press fabric of the third press nip, the top part of the front frame must remain in its closed position to provide support for the opened rear frame. The lower fabric of the first nip, which generally runs through the basement space of the paper machine hall, is replaced by conventional arrangements. It is seen from the foregoing that the Flip-Top frame construction has a "drawbridge" type construction having a bridge or span which is opened or pivoted around an articulated joint situated at the middle of the span so that only one half of the span can be opened at a time.

Frame constructions for press sections are disclosed in Finnish patent applications 844693 and 854959, assigned to applicants' assignee, in which the front frame and the rear frame are connected to each other and/or to an intermediate frame on which the center roll is mounted, by means of various openable and closeable intermediate frames situated above the front and rear frames.

When press roll arrangements having several nips are operated, space problems are usually encountered due to necessity of accommodating several different press rolls and their associated equipment in a relatively limited space. For this reason, it has been necessary to locate the frame parts that connect the front and rear frames to each other or to an intermediate frame, with their opening and closing means, in highly congested areas. This results in problems in both the construction and operation of the press section. An object of the invention is also to provide solutions for these problems.

SUMMARY OF THE INVENTION

In addition to the objects mentioned above, it is an object of the present invention to provide a new and improved press section and a new and improved press section/frame construction combination for the same which co-act in a synergistic manner with the various press rolls being fitted such that a more advantageous press construction is obtained both from the viewpoint of the pressing operation as well as from the viewpoint of the maintenance of the machine, including the press roll and fabric replacement operations.

Another object of the present invention is to provide new and improved press sections for paper machines wherein the web can be passed to and through the press section in a reliable manner as a closed draw reducing the possibility of web breakage.

Still another object of the present invention is to provide new and improved press sections of the type described above which additionally retain the most important and advantageous features of the Sym-Press press section and which have contributed to its great commercial success.

Briefly, in accordance with the present invention, these and other objects are obtained by providing a press section of the type described above wherein the first nip is formed between a pick-up suction roll situated within a loop of a first upper fabric, and a lower, hollow-faced press roll. The web is transferred by means of the suction zone of the pick-up suction roll from the forming wire of the paper machine onto the first fabric which carries the web into the first nip. A first lower press fabric is provided around the lower press roll. The web is carried on the lower surface of the first upper fabric into the second press nip.

A press section/frame construction combination in accordance with the invention which facilitates the replacement of press rolls and fabrics comprises a combination of:

(a) an at least partly open space located above the press roll combination and between front and rear frames, the front and rear frames being not directly connected to each other. Most of the press rolls can be replaced through the open space between the front and rear frames while the replacement of the upper press fabrics is also facilitated;

(b) a pick-up press-suction roll mounted in connection with the front side of the front frame and a lower press roll of the press nip;

(c) a hollow-faced press roll of the second nip mounted in connection with the front frame; and (d) a center roll supported from beneath by means of a stationary frame part, preferably an intermediate frame which is separate from the front and rear frames.

Thus, according to the invention, separate front and rear frames are provided which are not directed connected to each other. In this connection, the term "not directly connected to each other" means that the frame parts are at least not directly connected to each other by means of rigid frame beams as is usual. In this manner, a permanent space which is at least partly open is provided above the press roll arrangement which is not obstructed by massive frame components.

Where necessary, the open space above the press roll arrangement provided by the frame construction of the invention can be made wider by arranging the guide rolls of the upper fabrics located closest to and above the press roll combination so as to be detachable as well as displaceable to an inner position during the replacement of the press rolls and/or upper fabrics.

In accordance with the invention, a press section and associated frame construction combine in a synergistic manner to provide advantages heretofore not obtained by the prior art. For example, the loading of the pick-up suction roll in a press section according to the invention is lower than that acting on a press-suction roll in the prior Sym-Press construction since the pick-up suction roll is loaded by only a single nip. This results in the ability to use a suction roll in a press section according to the invention which is not as likely to be damaged and which possibly has a smaller diameter and mantle thickness, and consequently, lower costs in manufacture.

Unlike the Sym-Press construction, the only suction roll used in a press section according to the invention does not form a nip with the smooth-surfaced center roll. Rather, the pick-up felt and web supported by it have an upwardly inclined run after the suction roll, and for this reason, sufficient space is provided, for example, for a steam box if so desired.

The frame construction of the invention is advantageous in that the front frame, rear frame and optional intermediate frame can be designed independently of each other with sufficient rigidity to accommodate the particular vibrational loading to which it will be subjected during operation. In this connection it has recently been determined that, surprisingly, connection of the front and rear frames to each other by means of an upper intermediate frame does not materially reduce the tendencies of the frame parts to vibrate.

It is possible to use either press fabrics, preferably formed of plastic, in the form of a closed loop, or so-called seamable press fabrics in a frame constructed in accordance with the invention. Where such seamable press fabrics are used, it is not an absolute requirement that openable and closeable intermediate pieces be provided in the sides of the frame parts which results in a simpler and less costly frame construction.

DESCRIPTION OF THE DRAWINGS

A more complete appreciation of the present invention and many of the attendant advantages thereof will be readily understood by reference to the following detailed description when considered in connection with the following drawings which illustrate preferred embodiments to which the invention is in no way limited.

DETAILED DESCRIPTION OF THE PREFERRED EMBODIMENTS

Figure 1:
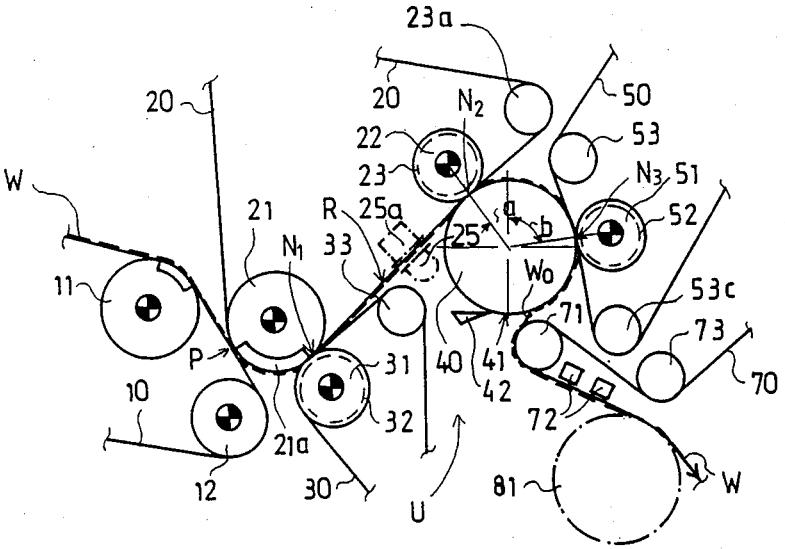
FIG. 1 is a schematic side elevation view of a three-nip embodiment of a press section in accordance with the invention.
Figure 2:
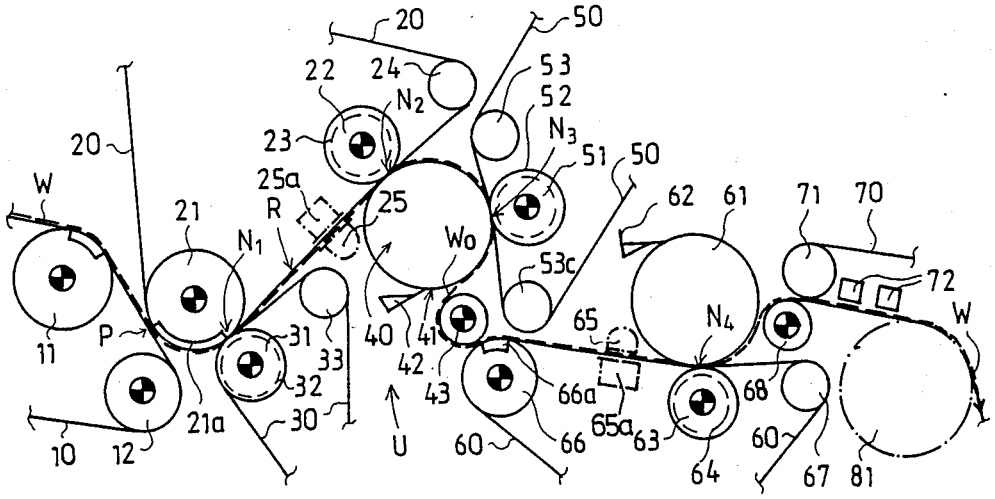
FIG. 2 is a schematic side elevation view of an embodiment of a press section in accordance with the invention which includes a separate press nip located after a compact press-roll arrangement.
Figure 3:
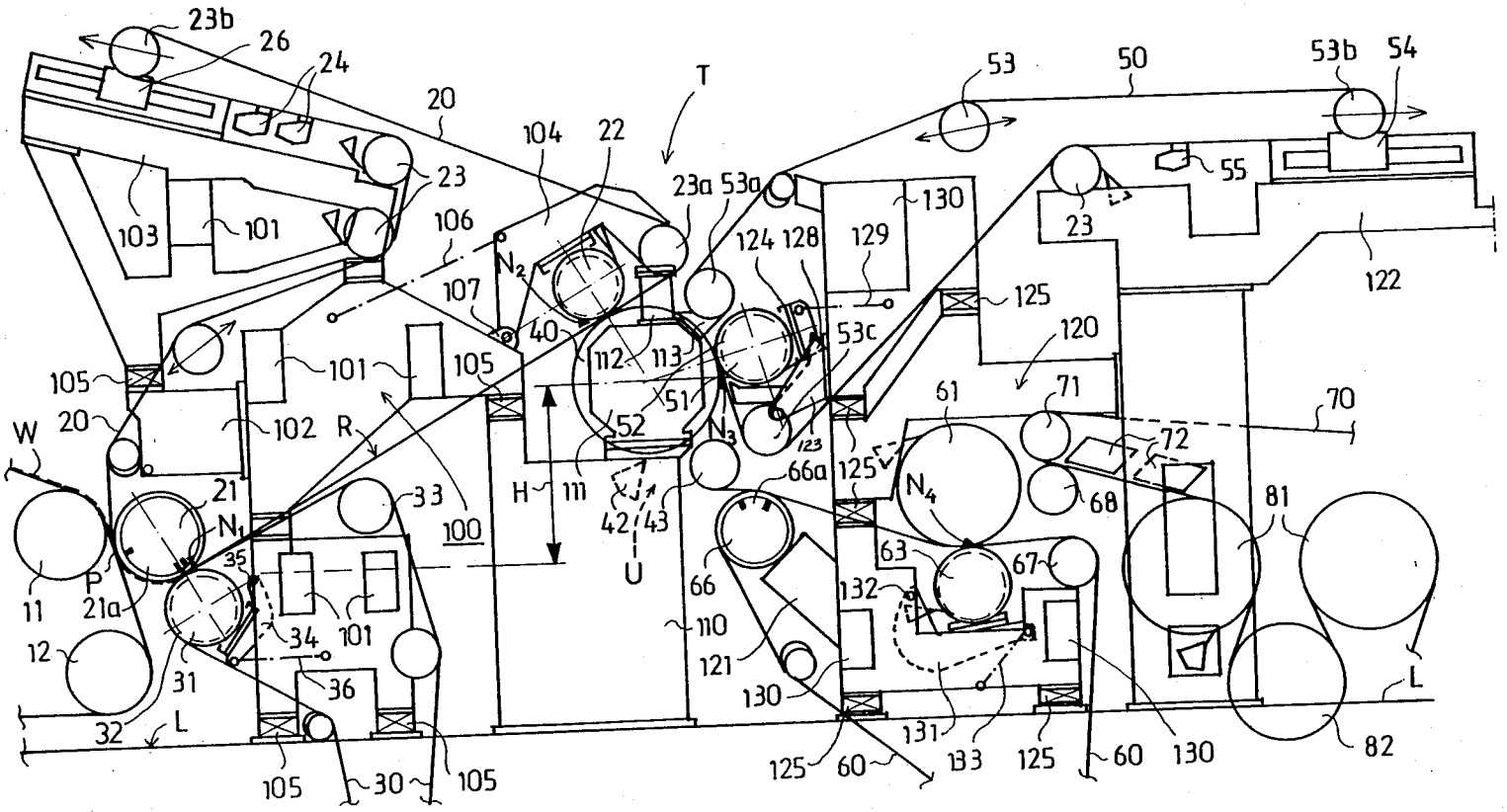
FIG. 3 is a schematic side elevation view of a press and associated frame construction combintion in accordance with the invention, the press section being the one illustrated in FIG. 2.

Referring now to the drawings wherein like reference characters designate identical or corresponding parts throughout the several views, and more particularly to FIGS. 1–3, a web W entering into the press section is formed on the wire 10 of the paper machine forming section. The web W is detached from wire 10 at the point P on the downwardly inclined run of forming wire 10 between rolls 11 and 12 and is transferred onto a first upper fabric 20 under the effect of the negative pressure in the suction sector 21*a* of pick-up roll 21. In addition to acting as a pick-up fabric, the first upper fabric 20 also acts as a press fabric in the first press nip $N_1$ and in the second press nip $N_2$. The first upper fabric is guided by guide rolls 23, 23*a* and tensioning roll 23*b*. A felt reconditioning device 24 (FIG. 3) is provided for fabric 20.

The first press nip $N_1$ is formed between the pick-up suction roll 21 and the press roll 31 which has a hollow face 32. The first press nip $N_1$ is a double-felted nip, the first fabric 20 acting as the upper felt, the lower felt passing through nip $N_1$ comprising a first lower fabric 30 guided by guide rolls 33. It is understood that some of the guide rolls 33 are located below the level of the floor L (FIG. 3) and are not shown. The lower roll 31 of nip $N_1$ may be a grooved roll, a blind-drilled roll, or a suction roll, and, in some special cases, may also comprise a smooth-surfaced roll. The first lower fabric 30 may also have a guide roll before the first nip $N_1$.

The first upper fabric 20 has a run R after the first double-felted press nip $N_1$ which is inclined upwardly. The upper fabric 20 carrying the web W moves into a second press nip $N_2$ formed between a center roll 40 having a smooth surface 41 and a press roll 22 having a hollow face 23. The first upper fabric 20, guided by guide rolls 23, 23*a*, and a tensioning roll 23*b*, passes through and acts as a press fabric in the second press nip $N_2$ which constitutes a first single-felted press nip.

It is important that the second nip $N_2$ be formed on the upper quadrant of the center roll 40 that is situated closer to the first press nip $N_1$.

A third press nip $N_3$ is formed by a press roll 51 having a hollow face 52 in nip-defining relationship with the center roll 40. A press fabric 50 constituting a second upper fabric guided by guide rolls 53, 53*a* and a tensioning roll 53*b*, passes through the third press nip $N_3$. The third press nip $N_3$ thus constitutes a second single-felted press nip.

The third nip $N_3$ is formed on the center roll 40 in opposed relationship to the second press nip $N_2$, i.e., on the upper quadrant of center roll 40 which is further from the first nip $N_1$, or proximate to the horizontal plane passing through the axis of rotation of the center roll 40.

The center roll 40 has a radius which is preferably larger than the radius of each of the other press rolls and preferably comprises a metal roll whose smooth surface 41 is formed of a material chosen such that the web W will adhere more readily to the roll surface 41 than to the fabric 20 so that the web W will readily detach from the surface 41 of roll 40 under the effect of a speed differential as the web W is transferred as an open draw $W_0$ from the press section to the drying section (FIG. 1) or into a fourth separate nip $N_4$ (FIGS. 2 and 3). The center roll 40 is permanently journaled on the frame part 110 of the paper machine machine so that its lower side opposite to the side on which nips $N_2$ and $N_3$ are formed faces a downwardly open space U. A doctor 42 is provided at the lower surface of the center roll so that in the event of a web break, the doctor 42 guides the web W through the open space U into a broke pulper (not shown) located beneath the press section.

In accordance with the embodiment of FIG. 1, the web W is detached as an open draw $W_0$ from the smooth surface 41 of center roll 40 by utilizing a speed differential and is transferred onto a drying fabric 70 of the drying section which is guided by guide rolls 71 and 73. Adhering to the lower surface of the drying fabric 70 by means of suction devices 72, the web is transferred onto the first drying cylinder 81 or onto a corresponding lead-in cylinder. In the FIG. 3 embodiment, a pair of upper cylinders 81 and a lower cylinder 82 are part of the initial drying group of the drying section.

In the embodiment of FIG. 2, the web W is detached from the surface 41 of roll 40 as an open draw $W_0$ and transferred by means of a speed differential over the guide roll 43 onto a second lower fabric 60 to which the web W adheres by means of a suction zone 66*a* of the guide roll 66. The fabric 60 carries the web W into a fourth separate nip $N_4$ formed between a smooth-surfaced upper roll 61 and a lower press roll 63 having a hollow face 64. The upper roll 61 is provided with a doctor 62. The web W is detached from the smooth surface of upper roll 61 and passed by means of guide roll 68 onto a drying fabric 70 in the manner described above.

According to the embodiments of FIGS. 1 and 2, the web W supported on the first upper fabric 20 has a run R between the press nips $N_1$ and $N_2$ during which a steam treatment is applied by means of a steam box 25. The steam treatment intensifies the dewatering in the second press nip $N_2$ and possibly in the third and fourth nips $N_3$ and $N_4$. The effect of the steam box may be intensified by a suction box 25*a* located at the opposite side of the upper fabric 20. In the embodiment of FIG. 2, a steam box 65 and a suction box 65*a* are also located between the third press nip $N_3$ and the fourth press nip $N_4$ on opposite sides of the second lower fabric 60 under the action of which the dewatering of the web in the last, i.e., the fourth nip $N_4$ is intensified.

The geometry of a press in accordance with the invention is preferably such that there is a difference in height H (FIG. 3) between the first press nip $N_1$ and a horizontal plane passing through the axis of center roll 40. Furthermore, the second press nip $N_2$ is situated at an angle a from a vertical plane passing through the axis of center roll 40, the magnitude of angle a being in the range of between about 5° to 80° and preferably within the range of between about 30° to 60°. The third press nip $N_3$ is situated at an angle b from the vertical plane passing through the axis of center roll 40. Angle b is generally within the range of between about 25° to 150° and preferably within the range of between about 45° to 100°. The diameter of center roll 40 is preferably about twice the diameter of press rolls 22, 31, 51. The diameter of suction roll 21 is preferably smaller than the diameter of center roll 40, but larger than the diameter of press rolls 22, 31 and 51. The diameters of the center roll 40 and of the upper roll 61 in the separate nip $N_4$ are preferably substantially equal to each other.

The press sections described above are further developments of the Sym-Press II press section. The Sym-Press II press section is a "compact" press section wherein a continuous series of nips are formed between the rolls and which includes one press-suction roll. On the other hand, a press section in accordance with the invention, although providing a closed draw for the web, is not quite so compact as the Sym-Press press section in that neither of the rolls forming the first double-felted press nip $N_1$ is in contact with the rolls forming the second nip $N_2$. However, a press section in accordance with the invention can be considered as a compact press section since the space required for it, particularly in the vertical direction, is not substantially larger than the space required by the Sym-Press press section.

The linear loads prevailing in nips $N_1$, $N_2$ and $N_3$ are preferably as follows:

$N_1$: 80±10 kN/m, roll pair suction/hollow-faced,
$N_2$: 110±10 kN/m, roll pair hollow-faced/smooth,
$N_3$: 140±10 kN/m, roll pair hollow-faced/smooth.

A press section/frame construction combination of the invention will now be described with reference to FIG. 3. The frame construction comprises, in the direction of web run, a front frame 100, an intermediate frame 110, and a rear frame 120. The front and rear frames 100 and 120 are independent structures which are separated from each other by a space T which is open in the upward direction. Replacement of the press rolls and of the upper press fabrics 20 and 50 is accomplished through the space T.

The pick-up suction roll 21 is mounted on support arms coupled to a projection part 102 mounted at the front end of the front frame 100. Reconditioning devices 24 for the first upper fabric 20 and tensioning means 26 for the tensioning roll **23*b* are mounted on the upper part 103 of front frame 100. Cantilevered beams 101 extend transversely across the front frame. The frame is also provided with openable intermediate pieces 105 which are mounted to the front frame in a manner such that they can be removed from the spaces normally occupied by them in order to facililate replacement of the first upper fabric 20 and the first lower fabric 30. The lower press roll 31 of the first nip $N_1$ is mounted on intermediate arms 34 which are pivotally attached to the lower part of the front frame 100 by horizontal articulated joints 35 located at the level of a lower set of the beams 101. Power units 36 are provided for pivoting intermediate arms 34 to open and to load the nip $N_1$. The upper press roll 22 of the second nip $N_2$ is mounted on downwardly open "U" or "V"-shaped angular arms 104 whose inner ends are pivotally mounted on the front frame 100 by means of horizontal articulated joints 107. Power units 106 are coupled to the angular arms 104** for pivoting the same to open and to load the nip $N_2$.

Figure 5:
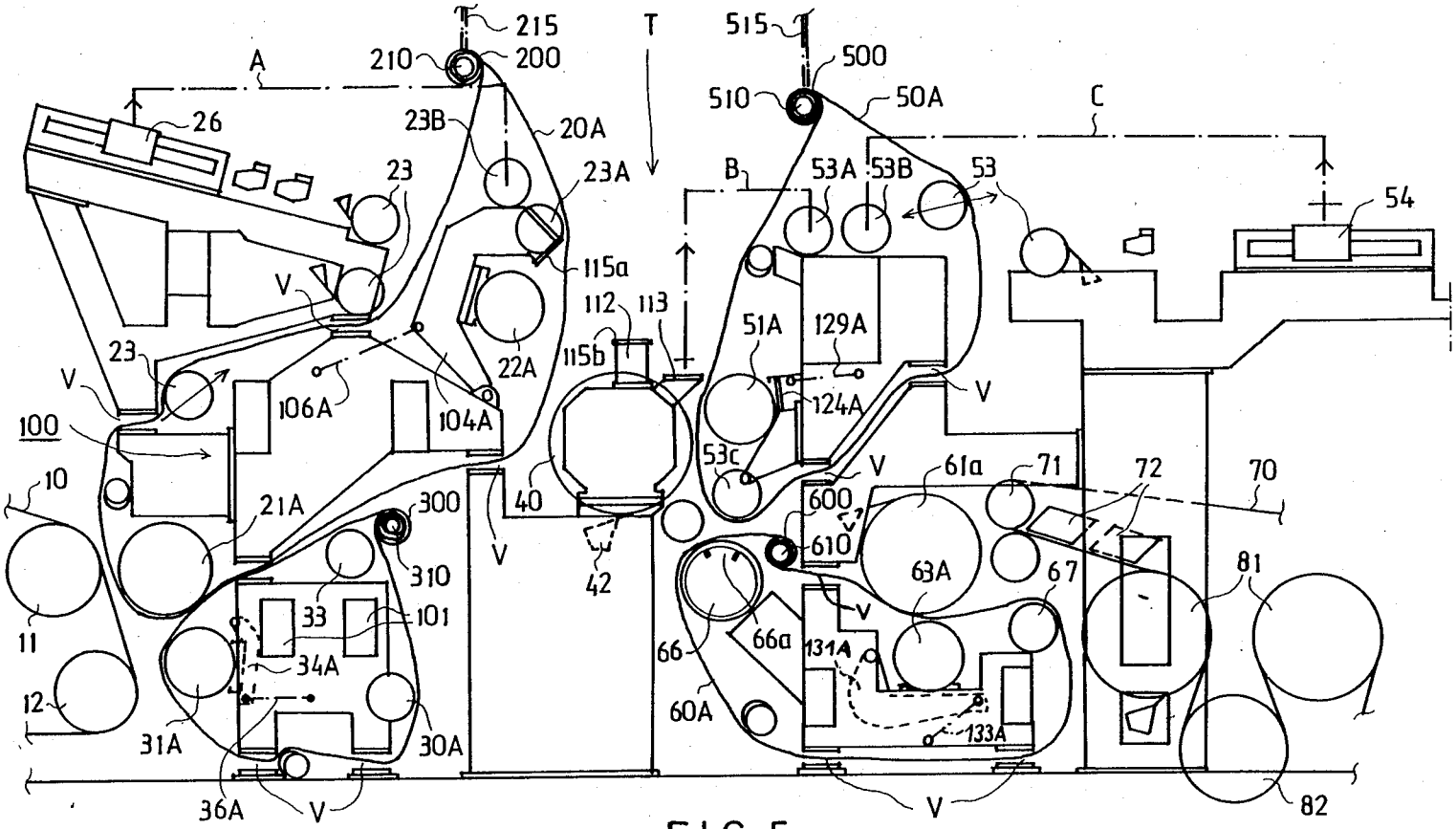
FIG. 5 is a view similar to FIG. 4 illustrating the replacement of various press fabrics.

The frame construction embodiment illustrated in FIG. 3 includes an intermediate frame 110 which is shorter in height than the front and rear frames 100 and 120. Bearing supports 111 for center roll 40 are mounted to the top side of intermediate frame 110 so as to permanently support the center roll 40 on the intermediate frame 110. Intermediate parts 112 and 113 are attached above the bearing supports 111. The outer ends of the angular arms 104 on which the press roll 22 is mounted are detachably connected to the intermediate parts 112 by means of an openable and closeable joint 115 comprising parts **115*a* and 115*b* (FIG. 5). The rearmost guide roll 23*a* for the first upper fabric 20 is also mounted on the outer ends of the angular arms 104. The foremost guide roll 53*a* for the second upper fabric 50 is correspondingly mounted on the second intermediate part 113**.

The use of an intermediate frame 110 is generally required in the case of press sections which include a fourth press nip $N_4$, e.g., in the case of press section embodiments of the type illustrated in FIG. 2. In press section embodiments of the type illustrated in FIG. 1 which include only three press nips, the center roll 40 is preferably permanently mounted either on the side of the front frame 100 or on the side of rear frame 120, such as on a part projecting therefrom.

The press roll 51 of the third press nip $N_3$ is supported on an intermediate part 124 which is connected to a projecting part 23 of rear frame 120 by horizontal articulated joints 128. Power units 129 are provided to pivot the intermediate arms 124 to load and to open the nip $N_3$. The guide roll **53*c* for fabric 50 is also supported on the projecting part 123 of rear frame 120. The suction roll 66 is mounted on a projecting part 121 of rear frame 120. The rolls 61 and 63 of the fourth press nip $N_4$ are supported within the rear frame 120, the upper roll 61 being permanently mounted while lower roll 63 is mounted on intermediate arms 131 which are pivotally attached to the rear frame 120 by horizontal articulated joint 132. Power units 133 are provided for pivoting arms 131** for opening and loading the fourth press nip $N_4$.

Rear frame 120 is provided with cantilevered beams 130 extending transversely across the frame construction. The service side of rear frame 120 is provided with openable intermediate pieces 125 which are removeable to form a through-opening in the service side of the rear frame through which fabrics 50 and 60 can be replaced as described in detail below. Reconditioning devices 55 for upper fabric 50 and tensioning means 54 on which guide roll **53*b* is mounted are attached to the top side of the projecting part 152 at the upper side of the rear frame 120**.

The replacement of the pick-up press roll 21 and of various other press rolls will now be described with reference to FIG. 4. The pick-up roll 21 is moved to the position 21A at the time of replacement whereupon fabric 20 is removed. The loops of a pair of lifting wires 201 suspended from a traverse crane are attached to the axle journals of the pick-up roll 21A.

The hollow-face press roll 22 of the second press nip $N_2$ is moved to the position 2A by pivoting the arms 104 by means of the power units 106A to the open position 104A whereby the guide roll **23*a* for fabric 20 is also displaced to an inner position 23A. In this manner, a relatively large space is opened between the center roll 40 and the press roll 22A. The axle journals of the press rolls 22A are attached to the lifting loops of lifting wires 23 whereupon the press roll 22A** is lifted from the frame construction by means of the traverse crane.

The upper roll 51 of the third press nip $N_3$ is moved to the position 51A and is replaced through the open space T provided between the front and rear frames 100 and 120 so that after the fabric 50 has been removed the roll 51A, suspended on the lifting loops of wires 205, is detached from its bearing support, and lifted by means of the traverse crane out of the press section through the space T.

The lower roll 31A of the first press nip $N_1$ is replaced after removing roll 21A. The roll 31A is detached from its bearing supports and suspended by its axle journals by the wire loops 202. Roll 31A is then lifted upwardly by means of the lifting wires, or, alternatively, can be withdrawn from the frame construction by moving the same axially, i.e. in its lengthwise direction, on a support carriage (not shown) located beneath the roll.

Figure 4:
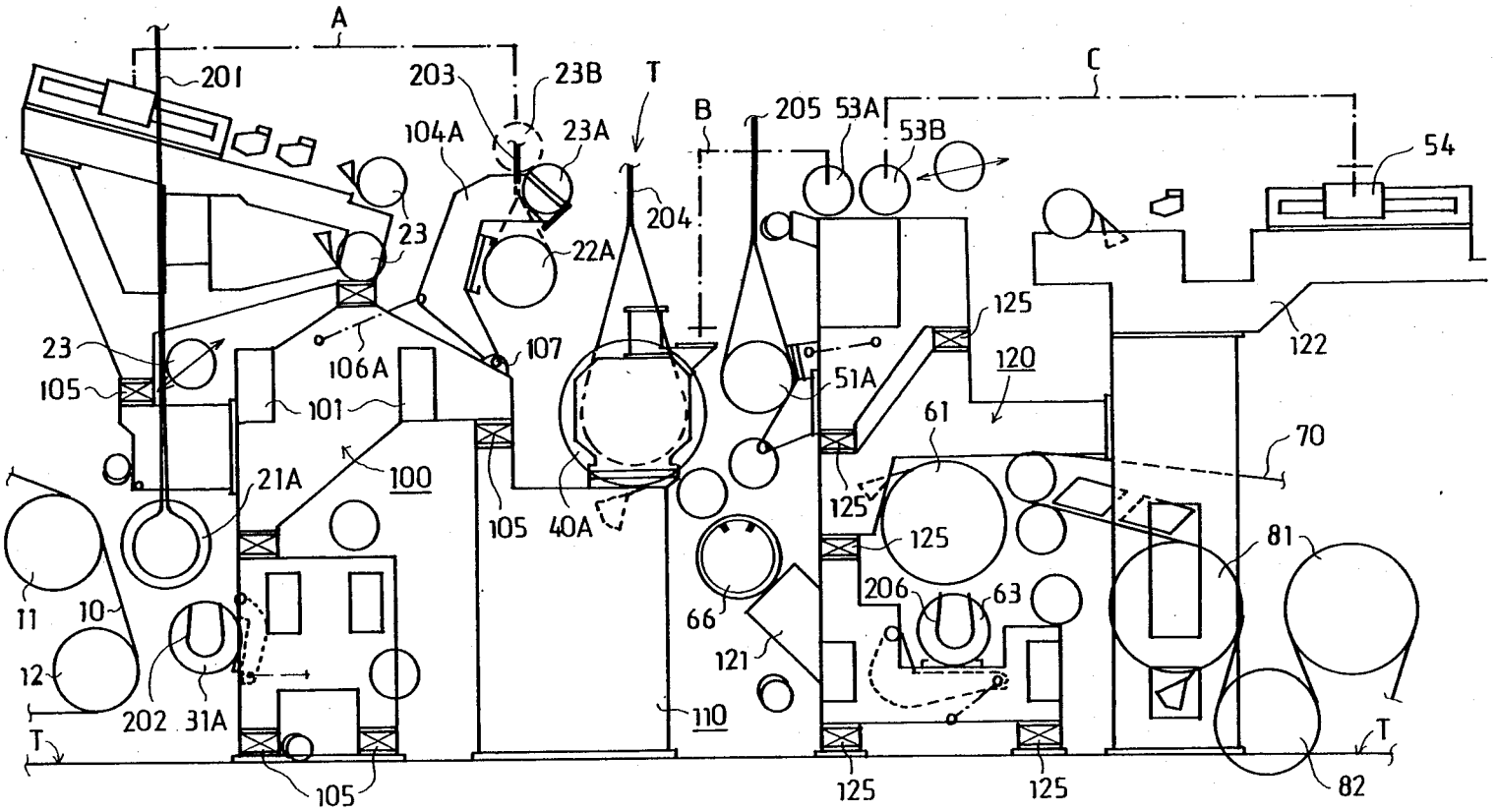
FIG. 4 is a schematic side elevation view of the press section and associated frame construction combination illustrated in FIG. 3 during replacement of press rolls.

The center roll 40 is replaced by suspending the same on the loops of lifting wires 204 and then lifting the center roll 40 out through the space T while the roll 22 and its support arms 104 are in the positions 22A and 104A shown in FIG. 4.

The rolls 61 and 63 of the fourth press nip $N_4$ are replaced by removing the same from the frame construction in their axial directions, the outer ends of the rolls being supported during the removal operation by means of a wire loop 206.

It will be understood that removal of the press rolls from the frame construction can be accomplished by a center-lifting technique rather than by supporting the rolls by their axle journals as described above. In such a case, which is especially suited for use in removing at least the heavier rolls, a single lifting wire is coupled to the roll substantially at its center of gravity. The lifting loops are arranged in the form of a downwardly open "V" and are secured around both sides of the plane containing the center of gravity of the roll. The center lifting technique is advantageous in that after the roll has been lifted vertically over the frame construction, it is easier to rotate the roll about its central vertical axis than in the case where the roll is supported at its axle journals, thereby facilitating the handling of the rolls during the replacement operation.

The new rolls to be installed in the frame construction are transported into position in the frame construction by performing the operations described above in connection with the replacement of the old rolls in a reversed sequence.

The replacement of the various fabrics in a press section/frame construction combination in accordance with the invention will now be described with reference to FIG. 5.

In the replacement of the first upper fabric 20, the intermediate pieces 105 provided in the front frame 100 at the service side thereof are opened to create free intermediate spaces V at the service side of the front frame 100. The pick-up suction roll 21 is shifted to an open position 21A and the press roll 22 situated within the loop of fabric 20 is displaced to the position 22A by pivoting the arms 104A by means of power units 106A to thereby open the nip $N_2$. The nip $N_1$ is opened by actuating power units 36A. The upper tension roll **23*b* supported on tensioning device 26 is displaced along a path A to a temporary position 23B supported on arms 24A so as to locate all of the rolls situated within the loop of fabric 20 sufficiently close to each other. In a similar manner, the other guide roll 23*a* situated above the front frame !00 is displaced along with arms 104A into a temporary inner position 23A. The old fabric 20** is then removed by cutting it off.

After the pick-up point P and the nips $N_1$ and $N_2$ have been opened and the rolls **23*a* and 23*b* moved to their inner position 23A and 23B and after the intermediate pieces 105 have been opened, the new loop of fabric 20A is passed through the intermediate spaces V formed in the service side of the front frame. The loop 20A is formed from a fabric roll 200 which is wound on a replacement pole 210. The replacement pole 210 is supported from both ends by means of lifting wires 15 suspended from the traverse crane in the paper machine hall. The loop 20A is spread out by unwinding the fabric 20 from the roll 200 to its full width and length. At the same time, the guide roll 23B is returned to its normal operating position along path A. After the fabric 20 has been spread out and tensioned, the pick-up point P and nips $N_1$ and $N_2$ are closed and the intermediate pieces 105 returned to their closed position and the fabric 20** tightened.

In the replacement of the first lower fabric 30, the guide rolls, which may be normally situated in the basement space of the paper machine hall supported on tensioning means, is moved to a temporary upper position. The lower ones of the intermediate pieces 105 are opened and the fabric loop 30A passed from a roll 300 around the beams 10!, press roll 31A and guide rolls 33. The intermediate pieces 105 are then returned to their closed position and the fabric 30 tensioned by means of devices (not shown) located in the basement of the paper machine hall. The second lower fabric 60 which is used in the case of a four nip press section is replaced in accordance with the same principles as the first lower fabric 30.

In the replacement of the second upper fabric 50, the intermediate pieces 125 are opened and guide roll **53*a* is moved along the path B to its temporary location 53A. In a corresponding manner, guide roll 53*b* is moved along the path C to a temporary location 53B alongside roll 53A. The nip $N_3$ is opened by displacing roll 51 to its upper position 51A by pivoting intermediate arms 124 to the position 124A by means of power units 129A. The fabric roll 500 supported on replacement pole 510 and lifting wire 515 is spread out to form a loop 50A and is passed around the press roll 51A and guide rolls 52, 52A, 53B and 53C through the intermediate spaces V. The rolls 53A and 53B are returned along paths B and C to their operating positions while the fabric 50A is unwound from roll 500. The nip $N_3$ is then closed and the fabric 50** tensioned.

Although the invention has been described above in connection with the replacement of fabric in looped form, it will be understood that it is within the scope of the invention to use seamable press and transfer fabrics. In such a case, the openable intermediate pieces 105 and 125 are not required in the frame construction.

Obviously, numerous modification and variations of the present invention are possible in the light of the above teachings. It is therefore to be understood that within the scope of the claims appended hereto, the invention may be practiced otherwise than as specifically disclosed herein.

What is claimed is:

1. A press section-frame construction combination in a paper machine, said paper machine including a forming section having a forming wire, comprising:

a first upper fabric;

a pick-up press-suction roll within a loop of said first upper fabric situated proximate to a run of the forming wire for transferring a web from the forming wire onto said first upper fabric;

a first lower fabric;

a first lower press roll within a loop of said first lower fabric situated in nip-defining relationship with said pick-up suction roll to form a first double-felted press nip;

a smooth-surfaced center roll;

a second press roll situated within the loop of said first upper fabric situated in nip-defining relationship with said center roll to form a second single-felted nip directly, consecutively following said first double-felted nip and through which only said first upper fabric passes;

said upper fabric having a substantially straight upwardly inclined run between said first double-felted nip and said second single-felted nip;

a frame construction on which said pick-up press-suction roll, said first and second press rolls, and said center roll are mounted, and wherein the web is transferred by said pick-up press-suction roll from the forming wire onto said first upper fabric and is carried on lower surface of said first upper fabric into said first double-felted nip wherein the web is dewatered through both of its faces, whereupon the web is carried supported on said first upper fabric over said substantially straight run into said second, single-felted nip whereupon the web separates from said first upper fabric and is carried on the surface of said smooth-surfaced center roll, a third press roll mounted on said frame construction and situated in nip-defining relationship with said center roll to form a third single-felted nip;

a second upper fabric passing through said third single-felted nip, wherein after separation from said first upper fabric, the web is carried on the surface of said smooth-surfaced center roll into said third single-felted nip, and wherein said second nip is located at a point above a horizontal plane passing through an axis of rotation of said center roll and on a side of a vertical plane passing through an axis of rotation of said center roll closer to said first nip, and wherein said third nip is located on the opposite side of said vertical plane.

2. The combination of claim 1 further including an additional separate press nip formed by a separate pair of press rolls mounted on said frame construction and an additional press fabric passing through said additional press nip.

3. The combination of claim 2 wherein said separate pair of press rolls forming said additional press nip comprises a smooth-surfaced upper roll and a hollow-faced lower roll around which a loop of said additional press fabric is provided.

4. The combination of claim 2, wherein said separate pair of roll is positioned such that dewatering direction in said additional separate nip is opposite to dewatering direction in said first and second nips.

5. The combination of claim 2, additionally comprising a steam box and a suction box situated substantially opposite one another on a run of said additional fabric before said additional press nip. smooth-surfaced upper roll and a hollow-faced lower roll around which a loop of said additional press fabric is provided.

6. The combination of claim 1 wherein said center roll is mounted on bearing supports, said first upper fabric is guided by a first set of guide rolls mounted on said frame construction and including a rearmost guide roll in a direction of web travel through said press section, and wherein said frame construction includes intermediate parts mounting said rearmost guide roll on an upper part of said center roll bearing supports.

7. The combination of claim 1 wherein said center roll is mounted on bearing supports, said second upper fabric is guided by a second set of guide rolls mounted on said frame construction including a foremost guide roll in the direction of web travel through said press section, and wherein said frame construction includes intermediate parts for mounting said foremost guide roll on an upper part of said center roll bearing supports.

8. The combination of claim 1 wherein, said frame construction comprises in the direction of travel of the web through said press section, a front frame and a separate rear frame spaced from said front frame to define a space between them which is at least partly open in the upward direction and through which at least said center roll and said second press roll can be replaced, said space also facilitating replacement of said first upper press fabric; and wherein said pick-up press-suction roll and lower first press roll are mounted in a region of a front side of said front frame;

said second press roll forming said second nip is mounted on said front frame; and said center roll is supported by a stationary frame part located beneath it.

9. The combination of claim 8 wherein said frame construction further comprises an intermediate frame separate from and situated between said front and rear frames, and wherein said stationary frame part supporting said center roll comprises said intermediate frame.

10. The combination of claim 8 further including bearing supports for mounting said center roll, arm members pivotally mounted at first ends thereof on said front frame, said second press roll defining said second nip being mounted on said arm members, and joint means provided on opposite ends of said arm members for removably coupling said arm members to said bearing supports of said center roll.

11. The combination of claim 10 wherein said first upper fabric is guided by a set of guide rolls mounted on said frame construction, including a rearmost guide roll in the direction of web travel through said press section, and wherein said rearmost guide roll is mounted on said arm members.

12. The combination of claim 8 further including a third press roll situated in nip-defining relationship with said center roll forming a third press nip, a second upper fabric passing through said third press nip, and an intermediate part coupled to a front side of said rear frame, said third press roll being mounted on said intermediate part.

13. The combination of claim 12 wherein said frame construction further comprises an intermediate frame having stationary support means, said intermediate frame being separate from and situated between said front and rear frames, and wherein said press section further comprises a set of guide rolls for guiding said second upper fabric, said set of guide rolls including a foremost guide roll in the direction of web travel through the press section, and foremost guide roll being mounted on said stationary support parts of said intermediate frame.

14. The combination of claim 13 further including bearing supports for said center roll mounted on said stationary parts of said intermediate frame.

15. The combination of claim 8 wherein said first upper fabric is guided by a set of first guide rolls mounted in said frame construction including a foremost guide roll in the direction of web travel through said press section;

a third press roll situated in nip-defining relationship with said center roll forming a third press nip, a second upper fabric passing through said third nip, and a set of second guide rolls mounted on said frame construction for guiding said second upper fabric including a foremost guide roll in the direction of web travel through the press section; and means for mounting said foremost guide roll for said second upper fabric on said frame construction for movement between an operating position and an inner position for replacement of said second upper fabric.

16. The combination of claim 15 further including a rearmost guide roll in the direction of web travel through the press section for guiding said second upper fabric; and means for mounting said rearmost guide roll for said second upper fabric on said frame construction for movement between an operating position and an inner position for replacement of said second upper fabric.

17. The combination of claim 15, further including means for mounting said foremost guide roll for said first upper fabric on said frame construction for movement between an operating position and an inner position for replacement of said first upper fabric.

18. The combination of claim 1, wherein said first and second press rolls are both hollow-faced.

19. The combination of claim 1, wherein said third press roll is hollow-faced.

20. The combination of claim 1, additionally comprising a steam box and a suction box situated substantially opposite one another on said straight run of said first upper fabric between said first and second nips.

* * * * *